US009411294B2

(12) United States Patent
Aoyama

(10) Patent No.: US 9,411,294 B2
(45) **Date of Patent: *Aug. 9, 2016**

(54) BYPASS FEEDER AND DOOR ON AN IMAGE FORMING APPARATUS

(71) Applicant: Jumpei Aoyama, Kanagawa (JP)

(72) Inventor: Jumpei Aoyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/683,336

(22) Filed: Apr. 10, 2015

(65) Prior Publication Data

US 2015/0212471 A1 Jul. 30, 2015

Related U.S. Application Data

(63) Continuation of application No. 14/151,874, filed on Jan. 10, 2014, now Pat. No. 9,037,073.

(30) Foreign Application Priority Data

Jan. 30, 2013 (JP) ..... 2013-015655

(51) Int. Cl.

| | |
|---|---|
| ***G03G 21/16*** | (2006.01) |
| ***G03G 15/00*** | (2006.01) |
| ***E05F 5/08*** | (2006.01) |

(52) U.S. Cl.

CPC ..... *G03G 15/6514* (2013.01); *E05F 5/08* (2013.01); *G03G 15/6529* (2013.01); *G03G 21/1633* (2013.01); *G03G 21/1647* (2013.01); *G03G 21/1695* (2013.01); *B65H 2402/45* (2013.01); *G03G 2215/00544* (2013.01); *G03G 2221/169* (2013.01); *G03G 2221/1675* (2013.01); *G03G 2221/1687* (2013.01)

(58) Field of Classification Search

CPC ..... E05F 5/06; E05F 5/08; E05F 3/227

See application file for complete search history.

(56) References Cited

U.S. PATENT DOCUMENTS

| | | | | |
|---|---|---|---|---|
| 6,854,781 | B2 * | 2/2005 | Roach | B62D 33/0273 296/50 |
| 7,526,214 | B2 | 4/2009 | Asaba | |
| 7,778,569 | B2 | 8/2010 | Igarashi | |
| 8,712,312 | B2 | 4/2014 | Lee et al. | |

FOREIGN PATENT DOCUMENTS

| | | | |
|---|---|---|---|
| JP | 2001130789 | A | 5/2001 |
| JP | 2007050972 | A | 3/2007 |
| JP | 2007057880 | A | 3/2007 |
| JP | 2008308329 | A | 12/2008 |
| JP | 2010097161 | A | 4/2010 |
| JP | 2012013828 | A * | 1/2012 |

* cited by examiner

*Primary Examiner* — Justin Olamit

(74) *Attorney, Agent, or Firm* — Harness, Dickey & Pierce, P.L.C.

(57) ABSTRACT

A bypass feeder, which is included in an image forming apparatus, includes an opening/closing unit opening and closing with respect to an apparatus body between a unit closed state and a unit open state, a bypass tray opening and closing with respect to the opening/closing unit between a tray closed state and a tray open state, a linkage including a flexible-member fixing member and connecting the opening/closing unit to the apparatus body, and a flexible member having one end fixed to the fixing member and the other end fixed to the bypass tray. When the opening/closing unit is changed to the unit open state while the bypass tray is rotated away from the opening/closing unit to the tray open state, the fixing member of the linkage shifts by pulling the flexible member to hold the bypass tray at a substantially horizontal line with respect to a sheet loading surface.

16 Claims, 11 Drawing Sheets

FIG. 11

| | SHEET TRAY | RESULTS OF SHEET FALL | |
|---|---|---|---|
| | ANGLE | FALLS/TESTS | JUDGEMENT |
| ↑ | +5.0° | 0/10 | GOOD |
| HORIZONTAL | 0° | 0/10 | GOOD |
| ↓ | −5.0° | 3/10 | ACCEPTABLE |
| | −7.5° | 6/10 | ACCEPTABLE |
| | −10.0° | 9/10 | ACCEPTABLE |
| | −12.5° | 10/10 | POOR |

GOOD: NO SHEET FALLS OFF TRAY
ACCEPTABLE: SOME SHEETS FALL OFF TRAY
POOR: ALL SHEETS FALL OFF TRAY

BYPASS FEEDER AND DOOR ON AN IMAGE FORMING APPARATUS

This patent application is a continuing application of and claims priority under 35 U.S.C. §120/121 to U.S. application Ser. No. 14/151,874, filed Jan. 10, 2014, which claims priority to 35 U.S.C. §119 to Japanese Patent Application No. 2013-015655, filed on Jan. 30, 2013 in the Japan Patent Office, which are hereby incorporated by reference herein in their entirety.

BACKGROUND

1. Technical Field

Example embodiments relate to a bypass feeder in which a bypass tray is attached to an opening/closing unit of an apparatus body of an image forming apparatus to be movable between an open position and a closed position, and an image forming apparatus including the bypass feeder.

2. Related Art

Image forming apparatuses such as printers and copiers generally include a bypass feeder to feed sheets such as recording sheets and OHP (overhead projector) films loaded on a bypass tray to a sheet conveying path of an apparatus body. Known bypass feeders include a bypass tray attached to an opening/closing unit that opens a sheet conveying path of an apparatus body of an image forming apparatus.

The opening/closing unit includes a fulcrum at a lower part thereof, and therefore an upper part (a free end) of the opening/closing unit can open and close with respect to the apparatus body of the image forming apparatus. The opening/closing unit stands in an upright attitude in a unit closed state and remains in an inclined attitude in a unit open state. By changing the opening/closing unit from the unit closed state to the unit open state, a sheet or sheets jammed in the sheet conveying path can be removed easily.

The bypass tray includes a fulcrum at a lower part thereof, and therefore an upper part (a free end) of the bypass tray can open and close with respect to the opening/closing unit. The bypass tray stands in an upright attitude in a tray closed state and remains in an inclined attitude in a tray open state. By changing the bypass tray from the tray closed state to the tray open state, the bypass tray can load a sheet or sheets to be fed to the sheet conveying path.

However, in the bypass feeder of this type, when the opening/closing unit is changed to the unit open state while a sheet is or sheets are loaded on the bypass tray in the tray open state, the upper part of the bypass tray becomes lower than the lower part thereof wherein the fulcrum is disposed, and the sheet falls off the bypass tray.

Japanese Patent Application Publication No. JP 2008-308329-A discloses a technique to prevent sheets from falling off a bypass tray. In this technique, an apparatus body of an image forming apparatus and the bypass tray are connected by a connecting member to regulate an angle of inclination of the bypass tray. With this configuration, the angle of inclination of the bypass tray does not become too great, and therefore the sheets loaded on the bypass tray are prevented from falling off the bypass tray.

However, in the configuration in JP 2008-308329-A employing the technique, one end of the connecting member is connected to the apparatus body of the image forming apparatus. Therefore, various units and components are disposed in the middle of a connecting path. Consequently, a complicated link mechanism is used in the configuration.

SUMMARY

At least one example embodiment provides a bypass feeder attached to an apparatus body of an image forming apparatus and including an opening/closing unit, a bypass tray, a linkage, and a flexible member. The opening/closing unit has an upper part and a lower part in a vertical direction. The opening/closing unit rotates the upper part about a fulcrum provided at the lower part and opens and closes between a unit closed state in which the opening/closing unit is disposed at a position close to the apparatus body and a unit open state in which the opening/closing unit is disposed at a position separated from the apparatus body. The bypass tray has a sheet loading surface on which a sheet is loaded, and has an upper part and a lower part having a fulcrum in a vertical direction. The bypass tray rotates the upper part about the fulcrum and opens and closes with respect to the opening/closing unit between a tray closed state in which the bypass tray is disposed at a position close to the opening/closing unit and a tray open state in which the bypass tray is disposed at a position separated from the opening/closing unit. The linkage includes a flexible-member fixing member and openably connects the opening/closing unit to the apparatus body. The flexible member has one end fixed to the flexible-member fixing member and the other end fixed to the bypass tray. When the opening/closing unit is changed from the unit closed state to the unit open state while the bypass tray rotates in a direction away from the opening/closing unit to the tray open state in which the sheet is loadable on the sheet loading surface thereof, the flexible-member fixing member of the linkage shifts by pulling the flexible member to hold the bypass tray at a substantially horizontal line with respect to the sheet loading surface.

Further, at least one example embodiment provides an image forming apparatus including an image forming unit to form an image on a recording medium, and the above-described bypass feeder.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein:

FIG. 11 is a table showing test results of a relation of angles of inclination of the bypass tray to a horizontal line and the number of falls of sheets loaded on the bypass tray.

DETAILED DESCRIPTION OF EXAMPLE EMBODIMENTS

Figure 1:
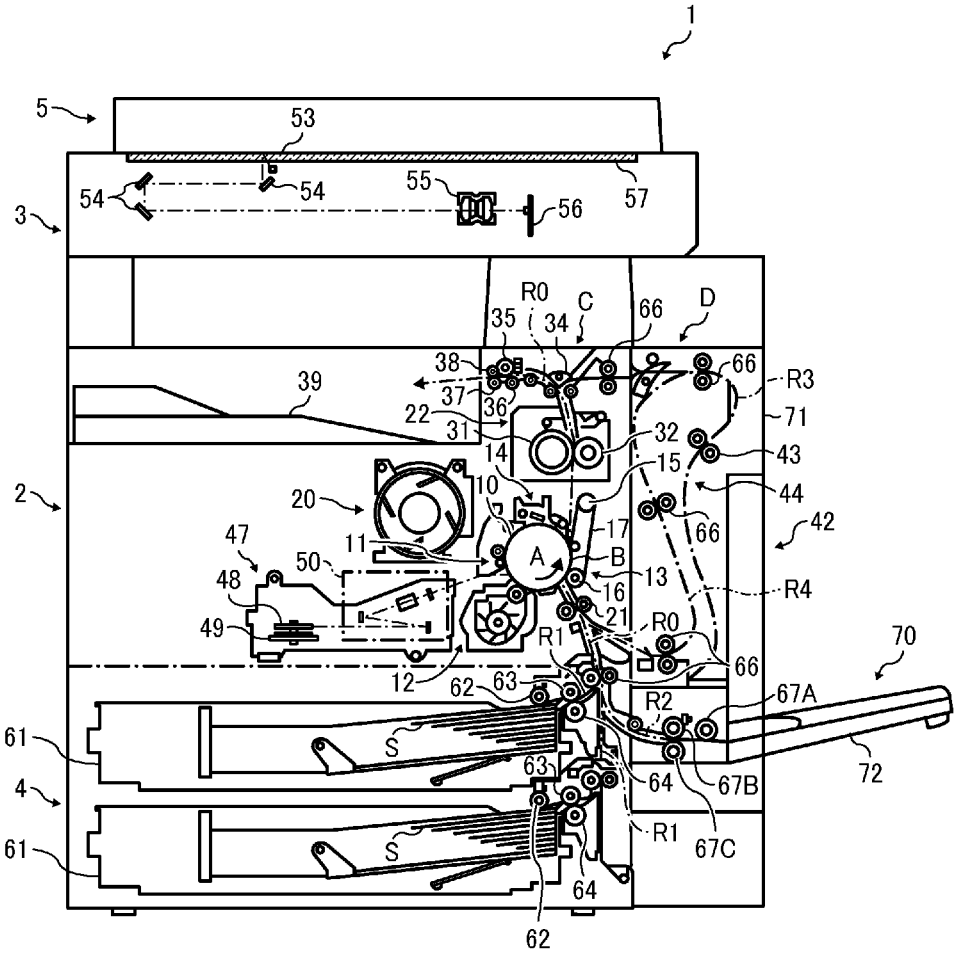
FIG. 1 is a vertical cross-sectional view illustrating a front side of a bypass feeder and an image forming apparatus according to an embodiment.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments.

Example embodiments are applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred example embodiments are described.

A description is given of a configuration of a bypass feeder and a configuration of an image forming apparatus including the bypass feeder according to an embodiment, with reference to FIGS. 1 through 11.

To make FIGS. 4 and 5 more visible, a sheet (or sheets) loaded on a bypass tray described below is not illustrated.

FIG. 1 is a side view illustrating a schematic configuration of an image forming apparatus 1 according to an example embodiment.

FIG. 1 is a vertical cross sectional view illustrating a schematic configuration of an image forming apparatus 1 according to an example embodiment. The image forming apparatus 1 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 1 is an electrophotographic color printer that forms color and monochrome toner images on recording media by electrophotography.

As illustrated in FIG. 1, the image forming apparatus 1 includes an apparatus body 2, an image reading device 3, a sheet feeding device 4, and an automatic document feeder (ADF) 5. The image reading device 3 is disposed above the apparatus body 2. The sheet feeding device 4 of table type is disposed below the apparatus body 2. The ADF 5 is openably disposed above the image reading device 3. The image forming apparatus 1 further includes a switchback unit 42 and a bypass feeder 70.

The apparatus body 2 includes a drum-shaped photoconductor 10 that functions as an image carrier provided therein. Image forming units and components are disposed around the photoconductor 10. For example, the units and components are a charger 11, a development unit 12, a transfer unit 13, and a cleaning unit 14 disposed in this order along a rotation direction of the photoconductor 10. In this case, the photoconductor 10 rotates counterclockwise as indicated by arrow A in FIG. 1. The transfer unit 13 includes a transfer belt 17 that is wound about rollers 15 and 16. The transfer belt 17 is pressed against a surface of the photoconductor 10 at a transfer position B.

A toner supply unit 20 is disposed at a left side of the charger 11 and the cleaning unit 14 in FIG. 1 to supply new toner to the development unit 12.

The apparatus body 2 further includes a sheet conveying unit C therein to feed a sheet functioning as a recording medium such as a regular paper and an overhead projector (OHP) sheet from a sheet feeding position and convey the sheet to a sheet stacking position via the transfer position B.

The sheet conveying unit C includes a sheet feeding path R1, a bypass sheet feeding path R2, and a sheet conveying path R0. The sheet conveying path R0 extends upwardly through a portion between the photoconductor 10 and the transfer unit 13 and turns left in FIG. 1, which forms a substantially L shape.

As described above, the sheet conveying path R0 includes a registration roller pair 21 disposed upstream from the photoconductor 10 in a sheet conveying direction.

A fixing unit 22 is disposed downstream from the photoconductor 10 in the sheet conveying direction. The fixing unit 22 includes a pair of fixing rollers (fixing roller bodies) 31 and 32. A fixing heater is disposed inside the fixing roller 31 and a pressure spring and a pressure arm are disposed around the fixing roller 32. Due to pressure applied from the pressure spring and the pressure arm, the fixing roller 32 is pressed against the fixing roller 31. The fixing roller 31 includes a thermistor and a thermostat.

Based on the temperature of the fixing roller 31 measured by the thermistor, the thermostat turns the fixing heater on or off. According to this operation, the fixing roller 31 is maintained at a given constant temperature.

A sheet discharging/separating claw 34, a sheet discharging roller 35, a first pressure roller 36, a second pressure roller 37, and a decurl roller 38 are disposed downstream from the fixing unit 22. A sheet discharging stacker 39, which corresponds to the sheet discharging position, is disposed beyond these components in the sheet conveying direction, so that a sheet with an image fixed thereto is discharged thereto.

A laser writing unit 47 is disposed on the left side of the development unit 12 in FIG. 1. The laser writing unit 47 includes a laser light source, a rotational polygon mirror 48 for scanning, a polygon motor 49, and optical scanning system 50 including an f-θ (f-theta) lens.

The image reading device 3 includes a light source 53, multiple mirrors 54, an optical imaging lens 55, and image sensor 56 such as charge coupled device (CCD). A contact glass 57 is provided on an upper surface of the image reading device 3.

The ADF 5 has one end that is connected at one end on the upper surface of the image reading device 3 by a connector having a hinge structure. The ADF 5 is openably attached to the image reading device 3 so that the ADF 5 turns from a substantially horizontal state in which a lower surface of the ADF 5 pressed an original document down onto a top surface of the contact glass 57 to an open state in which the lower surface of the ADF 5 opens at an angle of inclination of 90 degrees at maximum, for example, with respect to the top surface of the contact glass 57.

The ADF 5 includes a document loading tray at an original document loading position a document discharging tray at an original document discharging position, and a document conveying unit that includes a document conveying path through which a sheet such as an original document is conveyed from the document loading tray to the document discharging tray via a document reading position on the contact glass 57 of the image reading device 3. The document conveying unit includes multiple sheet conveying rollers (multiple sheet conveying rotary bodies) by which the sheet such as the document is conveyed.

The sheet feeding device 4 includes multiple sheet separating units 61 arranged along a vertical direction. The respective sheet separating units 61 correspond to sheet feeding positions of the sheet S. Each sheet separating unit 61 includes a pickup roller 62 and a feed roller 63, both functioning as sheet feed rollers, and a reverse roller 64 functioning as a separation roller. The sheet feeding path R1 is defined on the right side of the sheet separating units 61 disposed in the vertical direction in FIG. 1 to the sheet conveying path R0 of the apparatus body 2. The sheet feeding path R1 includes multiple sheet conveyance rollers 66 functioning as sheet conveying rotary bodies to convey the sheet forward.

The apparatus body 2 further includes a switchback unit 42 on the right side thereof in FIG. 1.

The switchback unit 42 includes a sheet conveying unit D that branches from the sheet discharging/separating claw 34 of the sheet conveying path R0. The switchback unit 42 includes a sheet reversing path R3 and a re-entry path R4. The sheet reversing path R3 conveys the sheet S to a switchback position 44 that includes a switchback roller pair 43. The re-entry path R4 extends from the switchback position 44 to guide the sheet S to the registration roller pair 21 disposed in the sheet conveying path R0.

Further, the sheet conveying unit D includes the multiple sheet conveyance rollers (the multiple sheet conveyance rotary bodies) 66 functioning as sheet conveying rollers to convey the sheet forward.

In an example embodiment, the switchback unit 42 is attached to an opening/closing unit 71, which will be described below.

The bypass feeder 70 is disposed openably closable to the right side surface of the apparatus body 2 of the image forming apparatus 1 in FIG. 1. The bypass feeder 70 includes a pickup roller 67A, a feed roller 67B, and a reverse roller 67C, each functioning as a sheet feed roller, to feed the sheet S loaded on the bypass tray 72 to the sheet conveying path R0 of the apparatus body 2.

Next, a description is given of image forming operations of the image forming apparatus 1.

To produce a copy of an image of an original document, a main switch is pressed and an original document is set on the ADF 5. Alternatively, the ADF 5 is opened to place the original document directly on the contact glass 57 of the image reading device 3. Closing the ADF 5 presses the original document on the image reading device 3.

As the start button is pressed, the sheet conveying roller causes the original document set on the ADF 5 to pass through a document conveying path. After the original document has moved onto the contact glass 57, the image reading device 3 is driven to read image data of the original document and discharge the original document to the document discharging tray.

By contrast, the image reading device 3 is driven immediately after the original document is set on the contact glass 57 directly.

When the image reading device 3 starts driving, the light source 53 is moved along the contact glass 57. Light emitted from the light source 53 is reflected on a document surface placed on the contact glass 57. The reflected light is then reflected by the multiple mirrors 54 and passes through the optical imaging lens 55. Then, the light enters the image sensor 56 to form an image. Accordingly, the image sensor 56 reads data on the document surface of the document.

At the same time, a photoconductor drive motor rotates the photoconductor 10. In the configuration of the image forming apparatus 1 illustrated in FIG. 1, as the photoconductor 10 rotates, the charger 11 uniformly charges the surface of the photoconductor 10. Then, based on image data obtained by the image reading device 3, the laser writing unit 47 emits the laser light to optically write an electrostatic latent image on the charged surface of the photoconductor 10. Thereafter, the development unit 12 supplies toner to be attracted to the surface of the photoconductor 10 to develop the electrostatic latent image to a visible toner image.

At the same time the start switch is pressed, the sheet S is fed by the pickup roller 62 from a corresponding one of the sheet separating units 61 disposed in the vertical direction in the sheet feeding device 4. The reverse roller 64 separates an uppermost sheet S from the subsequent sheets accommodated in the sheet separating unit 61, so that multi-feeding of the subsequent sheets can be prevented. Subsequently, the feed roller 63 conveys the sheet S to the sheet feeding path R1, then the sheet conveyance roller 66 guides the sheet S to the sheet conveying path R0, and the registration roller pair 21 abuts against the sheet S to stop further conveyance of the sheet S.

In synchronization with movement or rotation of the photoconductor 10 with the visible toner image formed on the surface thereof, the registration roller pair 21 is rotated to convey the sheet S to the right side of the photoconductor 10 in FIG. 1.

Alternatively, when the bypass feeder 70 is used, the bypass tray 72 of the bypass feeder 70 is changed from a tray closed state in which the bypass tray 72 is upright and disposed at a position close to the apparatus body 2 in an upright attitude to a tray open state in which the bypass tray 72 is inclined and disposed at a position separated from the apparatus body 2 in an inclined attitude, so as to load the sheet S on a sheet loading surface 72B of the bypass tray 72.

When the start switch is pressed, the pickup roller 67A picks up one sheet, followed by the feed roller 67B to feed the sheet S forward. When multiple sheets S are picked up and fed, the reverse roller 67C separates an uppermost sheet S from the subsequent sheets to prevent the subsequent sheets from being fed together with the uppermost sheet S. Then, the sheet conveyance rollers 66 conveys and guides the sheet S conveyed to the bypass sheet feeding path R2 to the sheet conveying path R0. Thereafter, similar to the operation in the sheet feeding device 4, the sheet S fed from the bypass tray 72 is conveyed to the right side of the photoconductor 10 at the registration roller pair 21 in FIG. 1 in synchronization with rotation of the photoconductor 10.

Then, the transfer device 13 transfers the toner image formed on the surface of the photoconductor 10 onto the sheet S sent to the right side of the photoconductor 10 at the transfer position B to form the image on the sheet S.

Residual toner remaining on the surface of the photoconductor 10 after image transfer by the transfer device 13 is removed by the cleaning unit 14. Then, an electric charge remover removes residual charge remaining on the surface of the photoconductor 10, so that the photoconductor 10 is prepared for the subsequent image forming operations that start from the charging by the charger 11.

Then, the sheet S after receiving the image from the transfer device 13 is conveyed by the transfer belt 17 and passes through the fixing roller pair 30 and 32 of the fixing unit 22 to fix the image to the sheet S by application of heat and pressure in the fixing unit 22. The sheet S with the toner image fixed thereto is conveyed by the first pressure roller 36, the sheet discharging roller 35, the second pressure roller 37, and the decurl roller 38 to be slightly curved for preventing the sheet S from being curled. Then, the sheet S is discharged to the sheet discharging stacker 39.

It is to be noted that, when the image is transferred onto both sides of the sheet S, the sheet discharging/separating claw 34 is switched to guide the sheet S having an image on a front side thereof from the sheet conveying path R0 to the sheet reversing path R3, and is conveyed by the multiple sheet conveyance rollers 66 to the switchback position 44. Then, the sheet S is conveyed to the re-entry path R4 to reverse the sides thereof, and is conveyed by the multiple sheet conveyance rollers 66. Accordingly, similar to the transfer operation onto the front side of the sheet S, the sheet S is guided to the sheet conveying path R0 to transfer the image formed on the surface of the transfer belt 17 onto a reverse side of the sheet S.

Figure 2:
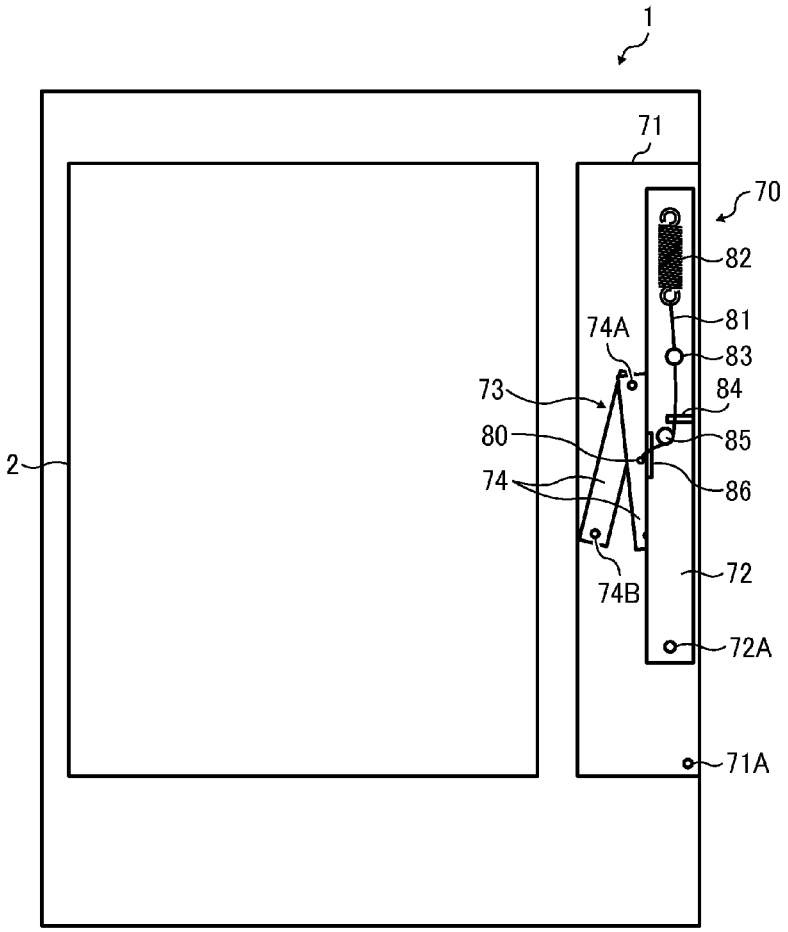
FIG. 2 is a side view illustrating a state in which both an opening/closing unit and a bypass tray of the bypass feeder of the image forming apparatus of FIG. 1 are closed.
Figure 3:
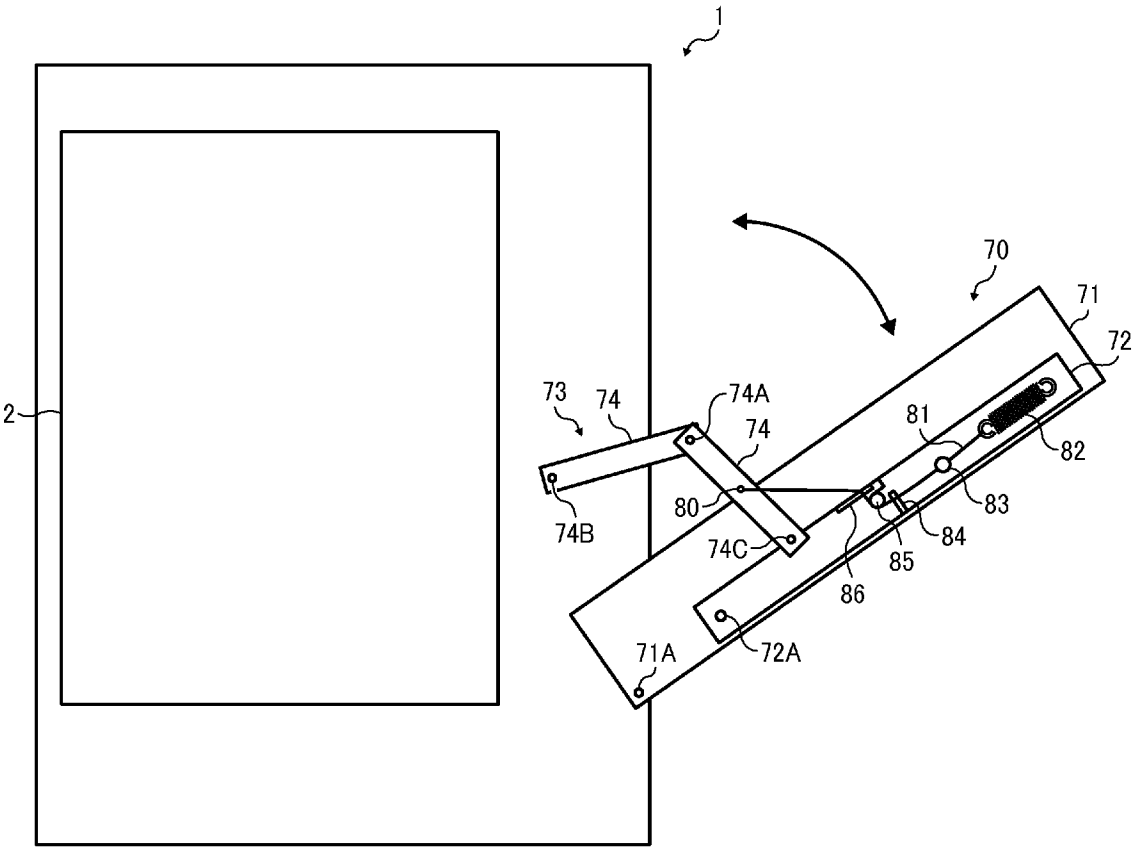
FIG. 3 is a side view illustrating a state in which the opening/closing unit is closed and the bypass tray is open.
Figure 4:
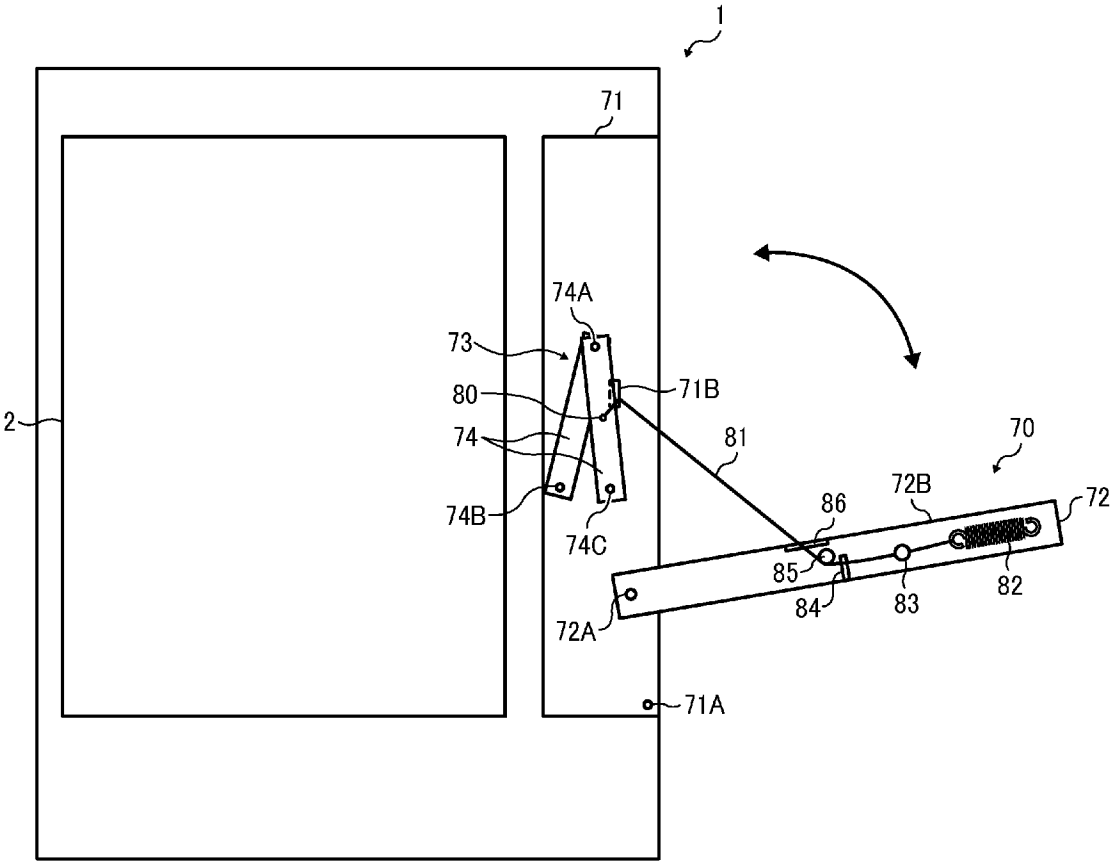
FIG. 4 is a side view illustrating a state in which the opening/closing unit is open and the bypass tray is closed.

In FIGS. 2 through 5, the bypass feeder 70 includes the opening/closing unit 71 and the bypass tray 72. The opening/closing unit 71 as illustrated in FIG. 3 includes a fulcrum 71A at a lower part thereof, and therefore an upper part (a free end) of the opening/closing unit 71 can open and close with respect to the apparatus body 2 of the image forming apparatus 1. The bypass tray 72 as illustrated in FIG. 4 includes a fulcrum 72A at a lower part thereof, and therefore an upper part (a free end) of the bypass tray 72 can open and close with respect to the opening/closing unit 71.

The bypass feeder 70 includes a link unit 73 and a linear member 81.

The link unit 73 links the opening/closing unit 71 to be openable and closable with respect to the apparatus body 2. The link unit 73 has a linear-member fixing member 80 that is a fixing member attached thereon.

The linear member 81 is a flexible member having one end fixed to the linear member fixing member 80 of the link unit 73 and an opposite end fixed to the bypass tray 72. The flexible linear member 81 is a wire in the present embodiment.

To easily perform removal of a jammed sheet or jammed sheets jammed in the sheet conveying path R0 and/or the re-entry path R4 or maintenance of units and components inside the apparatus body 2, the opening/closing unit 71 is moved to the tray open state to expose the sheet conveying path R0 and the re-entry path R4, as illustrated in FIG. 3. Specifically, the bypass feeder 70 can expose the sheet conveying path R0 and the re-entry path R4 by changing the position of the opening/closing unit 71 from the tray closed state in the upright attitude as illustrated in FIG. 2 to the tray open state in the inclined attitude as illustrated in FIG. 3. By so doing, removal of a jammed sheet and maintenance provided inside the apparatus body 2 can be performed easily.

Further, by changing the position of the bypass tray 72 from the tray closed state in the upright attitude as illustrated in FIG. 2 to the tray open state in the inclined attitude as illustrated in FIG. 4 to load the sheet S on the sheet loading surface 72B of the bypass tray 72, the bypass feeder 70 can feed and convey the sheet S to the sheet conveying path R0.

The link unit 73 employs a leg open linkage including two arms 74 having a first arm and a second arm. One end of the first arm of the arms 74 is openably connected to one end of the second arm of the arms 74 using the fulcrum 74A. The other end of the first arm of the arms 74 is connected rotatably about the fulcrum 74B with respect to the apparatus body 2. The other end of the second arm of the arms 74 is connected rotatably about the fulcrum 74C with respect to the opening/closing unit 71.

Figure 7:
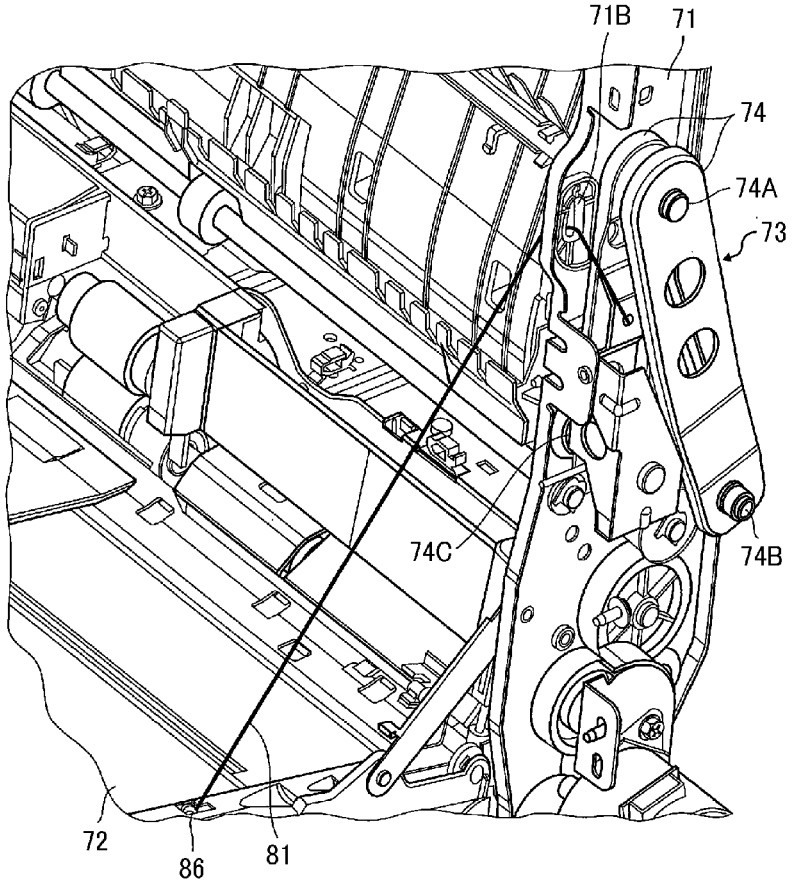
FIG. 7 is a perspective view illustrating an inner configuration of the opening/closing unit with the bypass tray open.

The link unit 73 is disposed on a side surface of the opening/closing unit 71 when the opening/closing unit 71 is in the tray closed state, as illustrated in FIG. 7. The other end of the second arm of the arms 74 is connected rotatably about the fulcrum 74C to the side surface of the opening/closing unit 71.

By opening and closing the two arms 74, the link unit 73 can open and close the opening/closing unit 71. As the two arms 74 open and stretch, the opening/closing unit 71 can remain the position and angle of inclination in the tray open state as illustrated in FIG. 3.

The linear-member fixing member 80 of the link unit 73 is provided at the intermediate part of one of the arms 74. In the present embodiment, the linear-member fixing member 80 of the link unit 73 is provided at the intermediate part of the second arm of the arms 74, which is rotatably connected to the side surface of the opening/closing unit 71.

Figure 5:
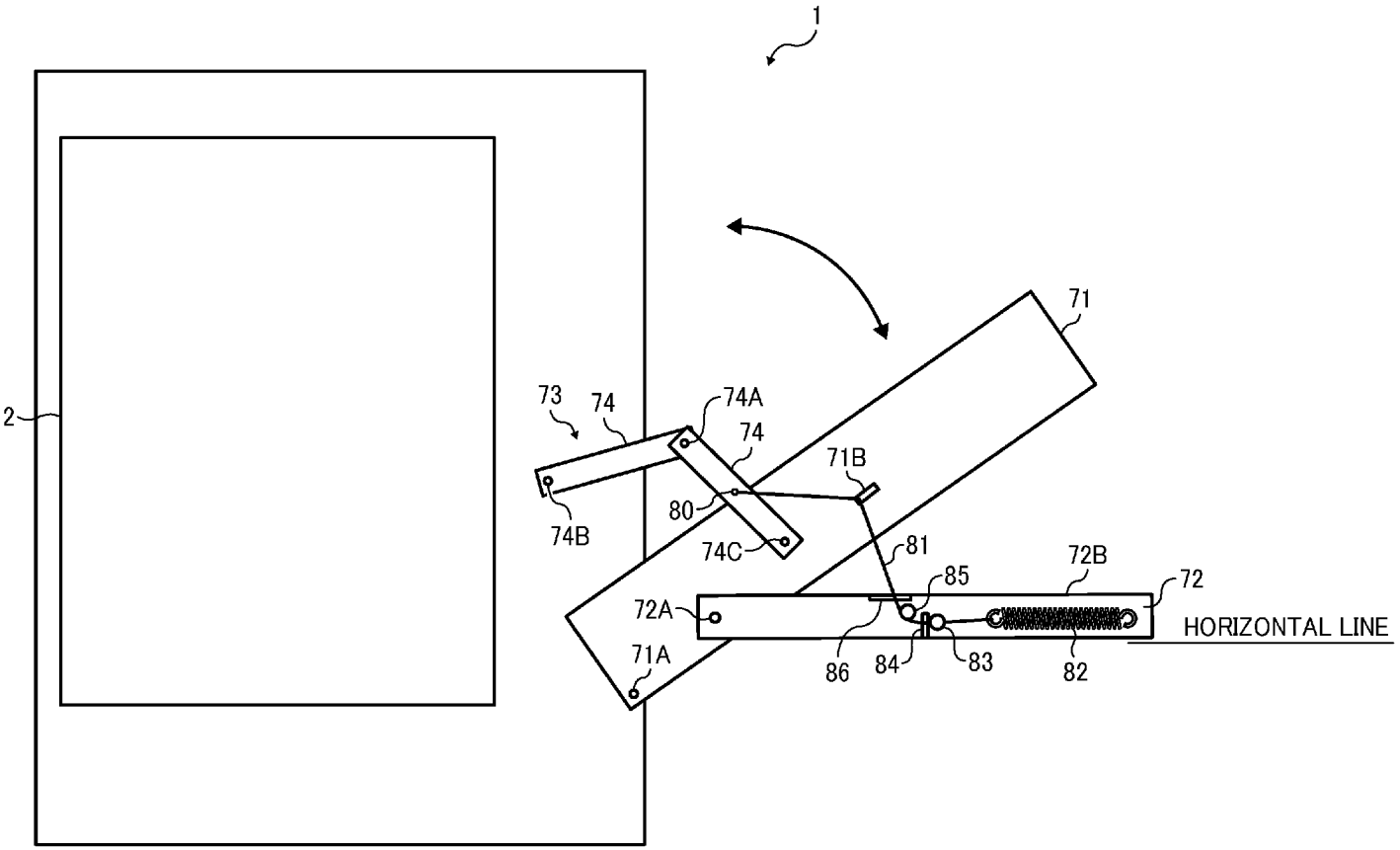
FIG. 5 is a side view illustrating a state in which both the opening/closing unit and the bypass tray are open.

The bypass feeder 70 has a configuration in which, when the opening/closing unit 71 is moved from a unit closed state in which the opening/closing unit 71 is in the upright attitude (as illustrated in FIG. 4) to a unit open state in which the opening/closing unit 71 is in the inclined attitude (as illustrated in FIG. 5), the linear-member fixing member 80 of the link unit 73 moves to a direction to stretch the linear member 81, so that the bypass tray 72 retains an angle of inclination to the horizontal line, which is sufficient to prevent the sheet S loaded on the sheet loading surface 72B of the bypass tray 72 from falling off the bypass tray 72. A travel amount of the linear-member fixing member 80 can be adjusted depending on a position to fix one end of the linear member 81 to the link unit 73.

Figure 6:
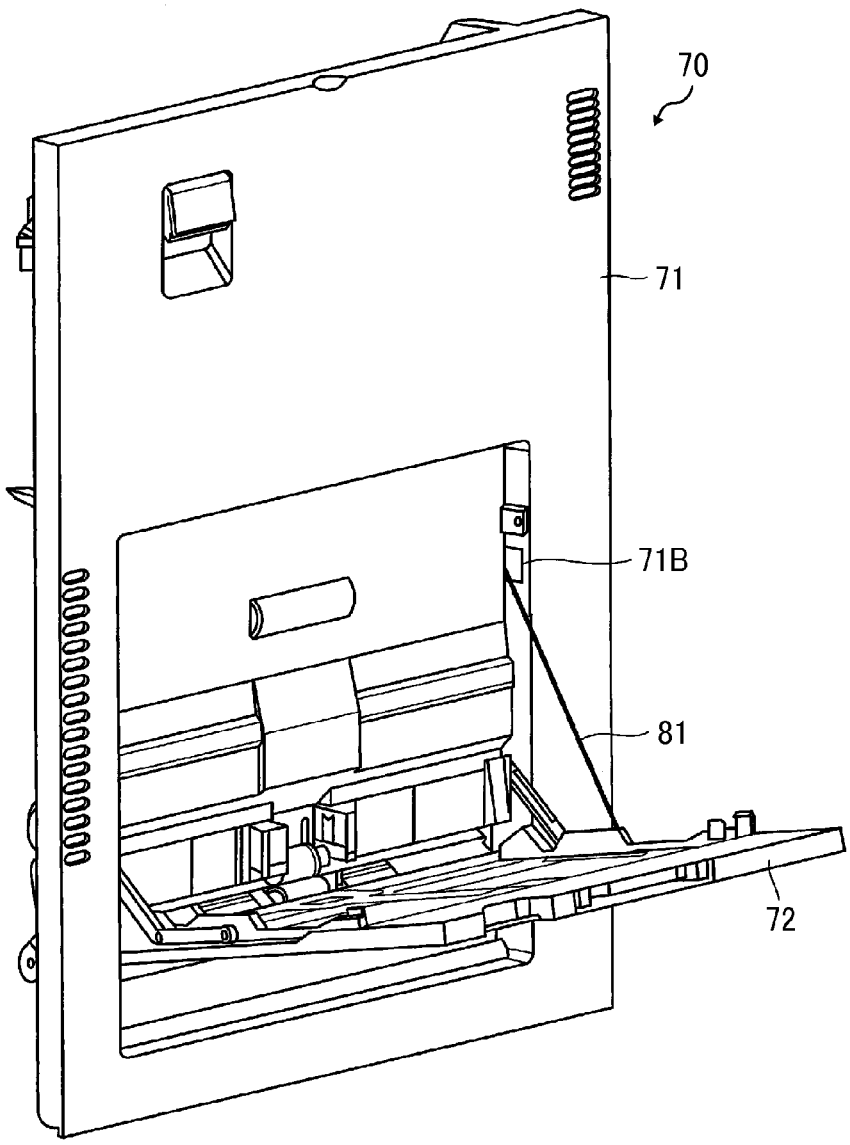
FIG. 6 is a perspective view illustrating a state in which the bypass tray is open.

As illustrated in FIGS. 6 and 7, the opening/closing unit 71 includes a through hole 71B through which the linear member 81 passes. One end of the linear member 81 is fixed to the link unit 73 through the through hole 71B.

In the bypass tray 72, the other end of the linear member 81 is connected to a spring 82 that is an elastic member to pull the linear member 81. One end of the spring 82 is fixed to the other end of the linear member 81. The other end of the spring 82 is fixed to the bypass tray 72. As an example of the spring 82, an extendable coil spring is used.

A position fixing member 83 is disposed at the other end of the linear member 81. A stopper 84 is provided on the bypass tray 72. The bypass tray 72 includes a pulley 85 to change an extending direction of the linear member 81. By contacting the position fixing member 83 to the stopper 80, the bypass feeder 70 has a configuration in which the angle of inclination of the bypass tray 72 to the horizontal line.

Figure 8:
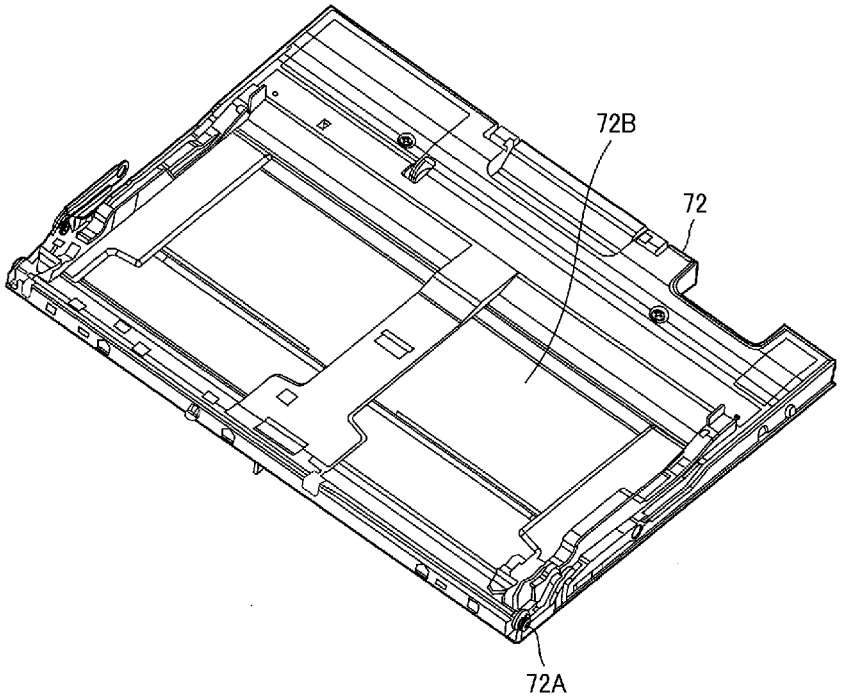
FIG. 8 is a perspective view illustrating a configuration of the bypass tray.
Figure 9:
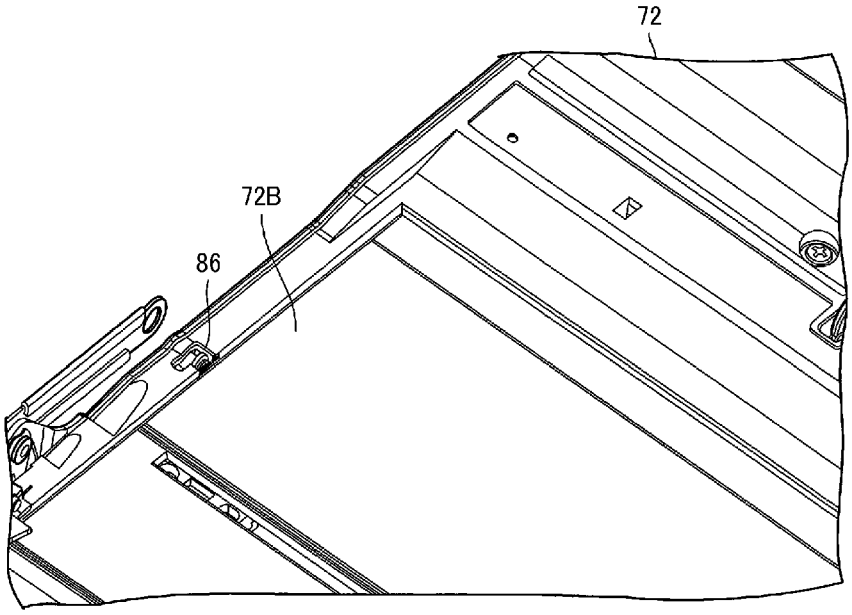
FIG. 9 is an enlarged perspective view illustrating the configuration of the bypass tray of FIG. 8.

The bypass tray 72 has a rectangular shaped surface as illustrated in FIG. 8. As illustrated in FIG. 9, the bypass tray 72 includes a through hole 86 formed on one side of two opposite lines disposed separated in a direction perpendicular to the sheet feeding direction of the sheet S loaded on the sheet loading surface 72B. The through hole 86 extends the linear member 81 from the inside of the bypass tray 72 to the outside thereof. The linear member 81 passes through the through hole 86.

Figure 10:
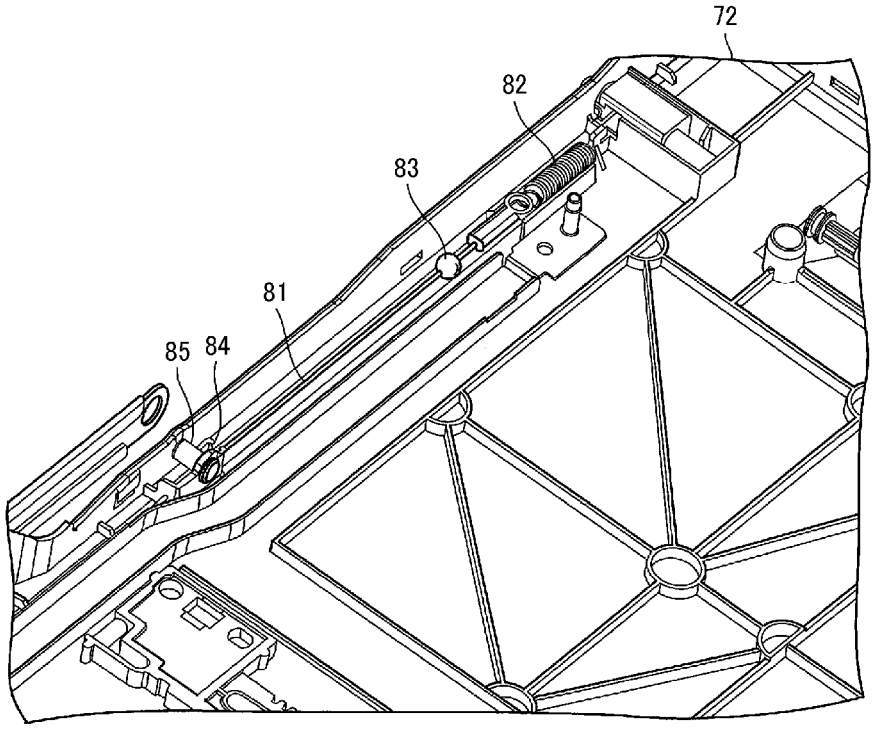
FIG. 10 is a perspective view illustrating an inner configuration of the bypass tray.

As illustrated in FIG. 10, the spring 82, the position fixing member 83, the stopper 84, and the pulley 85 are disposed along one line of the bypass tray 72, which is similar to the through hole 86.

Next, relations of the unit open state and the unit closes state of the opening/closing unit 71, the tray open state and the tray closed state of the bypass tray 72, the linear member 81, the spring 82, and the position fixing member 83 are described.

A detailed description is given of the states of the opening/closing unit 71 and the bypass tray 72 with reference to FIGS. 2 through 5.

In FIG. 2, the opening/closing unit 71 is in the upright attitude in the unit closed state with respect to the apparatus body 2 and the bypass tray 72 is in the upright attitude in the tray closed state with respect to the opening/closing unit 71. At this time, the linear member 81 is slackened and the spring 82 is contracted. The position fixing member 83 of the linear member 81 is separated from the stopper 84 of the bypass tray 72.

In FIG. 3, the opening/closing unit 71 is in the inclined attitude in the unit open state with respect to the apparatus body 2 and the bypass tray 72 is in the upright attitude in the tray closed state with respect to the opening/closing unit 71. At this time, the linear-member fixing member 80 of the link unit 73 is shifted from the unit closed state to the unit open state in a direction in which the opening/closing unit 71 pulls the linear member 81. However, the linear member 81 is sagged without being tensioned. The spring 82 remains contracted. The position fixing member 83 of the linear member 81 is separated from the stopper 84 of the bypass tray 72. The position and angle of inclination of the opening/closing unit 71 in the unit open state with respect to the apparatus body 2 are held by opening and stretching the arms 74 of the link unit 73.

In FIG. 4, the opening/closing unit 71 is in the upright attitude in the unit closed state with respect to the apparatus body 2 and the bypass tray 72 is in the inclined attitude in the tray open state with respect to the opening/closing unit 71. At this time, the linear-member fixing member 80 of the link unit 73 is not moved from the unit closed state. However, the linear member 81 pulls the spring 82. Therefore, the linear member 81 is not slackened. The position fixing member 83 of the linear member 81 is separated from the stopper 84 of the bypass tray 72. The position and angle of inclination of the bypass tray 72 in the tray open state with respect to the opening/closing unit 71 are held by a positioning mechanism that is different from the linear member 81.

In FIG. 5, the opening/closing unit 71 is in the inclined attitude in the unit open state with respect to the apparatus body 2 and the bypass tray 72 is in the inclined attitude in the tray open state with respect to the opening/closing unit 71. At this time, the linear-member fixing member 80 of the link unit 73 is shifted from the unit closed state to the unit open state in the direction in which the opening/closing unit 71 pulls the linear member 81. The position fixing member 83 of the linear member 81 contacts the stopper 84 of the bypass tray 72. The position and angle of inclination of the bypass tray 72 to the horizontal line in the tray open state with respect to the opening/closing unit 71 is held due to contact of the position fixing member 83 with the stopper 84.

Generally, the bypass tray 72 can open to a given angle of inclination with respect to the opening/closing unit 71 by the positioning mechanism different from the linear member 81. However, in the configuration according to the present embodiment, the bypass tray 72 is supported by the link unit 73 with assistance of the linear member 81. With this configuration, as the bypass tray 72 turns to open, the linear member 81 gradually stretches. When the bypass tray 72 reaches the angle of inclination where the position fixing member 83 of the linear member 81 contacts the stopper of the bypass tray 72, the linear member 81 is stretched with tension, where the bypass tray 72 is stopped. Therefore, the bypass tray 72 stops at an intermediate position that is different from a tray stop position where the bypass tray 72 stops when the bypass tray 72 is in the tray open state and the opening/closing unit 71 is in the unit closed state.

At this time, the bypass feeder 70 holds the bypass tray 72 at the angle of inclination that can prevent the sheet S loaded on the bypass tray 72 from falling off the bypass tray 72. Therefore, the sheet S remains on the bypass tray 72.

Specifically, when the opening/closing unit 71 is changed from the unit closed state (shown in FIG. 4) to the unit open state (shown in FIG. 5) while the bypass tray 72 is in the tray open state (shown in FIG. 4), the linear-member fixing member 80 of the link unit 73 is moved in the direction in which the linear member 81 is stretched. Consequently, the linear member 81 maintains the bypass tray 72 inclined to a substantially horizontal line in which the sheet S does not slidably fall from the bypass tray 72. By so doing, the sheet S can be prevented from falling off the bypass tray 72.

Here, a description is given of the angle of inclination of the bypass tray 72 to the horizontal line, with reference to FIG. 11.

In FIG. 11, a table shows results of a test on various angles of inclination of the bypass tray 72. Positive angles of inclination in FIG. 11 show angles to the horizontal line when the upper part (the free end) of the bypass tray 72 is located higher than the lower part thereof near the fulcrum 72A. Negative angles of inclination in FIG. 11 show angles to the horizontal line when the upper part (the free end) of the bypass tray 72 is located lower than the lower part thereof near the fulcrum 72A.

The table shows that when the angle of inclination is minus 10 (−10) degrees to the horizontal line, the result is accepted because frictional forces are exerted between the bypass tray 72 and the sheet S and between the sheets S loaded on the sheet loading surface 72B of the bypass tray, and therefore the sheet S does not slide to fall from the bypass tray 72 due to gravitating.

According to the test results shown in FIG. 11, the sheet S slides to fall from the bypass tray 72 when the angle of inclination of the bypass tray 72 reaches minus 12 (−12) degrees or above. This is because the bypass tray 72 is inclined by minus 12 degrees or above, a sliding force caused by gravitating becomes greater than the static friction force, and the sheet S cannot help from falling off the bypass tray 72. Consequently, it is preferable that the bypass tray 72 is inclined by minus 10 degrees or below to prevent the sheet S loaded on the bypass tray 72 from sliding and falling from the sheet loading surface 72B of the bypass tray 72.

In the present embodiment, one end of the linear member 81 of the bypass feeder 70 is fixed in an intermediate position of the second arm of the arms 74 of the link unit 73. With this configuration, the bypass feeder 70 does not include various units and components in the middle of a connecting path as provided in the apparatus body 2 of the image forming apparatus 1.

Further, the bypass feeder 70 has a configuration in which the link unit 73 and the bypass tray 72 are connected by the linear member 81 having a simple link mechanism. With this configuration, when the opening/closing unit 71 is changed from the unit closed state (shown in FIG. 4) to the unit open state (shown in FIG. 5) while the bypass tray 72 is in the tray open state (shown in FIG. 4), the linear-member fixing member 80 is moved in the direction in which the linear member 81 is stretched. Consequently, the linear member 81 maintains the bypass tray 72 to be inclined to a substantially horizontal line in which the sheet S does not slidably fall from the bypass tray 72.

As described above, the image forming apparatus 1 according to the present embodiment can achieve the following effects.

The bypass feeder 70 has a configuration in which, when the opening/closing unit 71 is changed from the unit closed state to the unit open state while the bypass tray 72 is in the tray open state, the linear-member fixing member 80 of the link unit 73 is moved in the direction in which the linear member 81 is stretched. Consequently, the bypass tray 72 is maintained at the angle of inclination to the horizontal line in which the sheet S does not slidably fall from the bypass tray 72. Accordingly, even when the opening/closing unit 71 is changed from the unit closed state to the unit open state while the bypass tray 72 is in the tray open state, the sheet S loaded on the sheet loading surface 72B of the bypass tray 72 does not slide and fall from the bypass tray 72.

Further, the bypass feeder 70 does not include various units and components in the middle of the connecting path that connects the link unit 73 and the bypass tray 72 by the linear member 81. Accordingly, when the opening/closing unit 71 is changed from the unit closed state to the unit open state while the bypass tray 72 is in the tray open state, the bypass tray 72 is held at the angle of inclination at which the sheet S does not slide and fall form the bypass tray 72. This maintenance mechanism can be achieved with a simpler configuration compared with a configuration in which the apparatus body 2 of the image forming apparatus 1 and the bypass tray 72 are connected by a known connecting member.

As a result, the bypass feeder 70 and the image forming apparatus 1 according to the present embodiment can be provided to prevent the slidably falling of the sheet S from the sheet loading surface 72B of the bypass tray 72.

Further, in the bypass feeder 70 according to the present embodiment, one end of the linear member 81 is fixedly connected to the link unit 72. Therefore, the length of the linear member 81 can be reduced when compared with a known configuration in which one end of a link member is connected to an apparatus body of an image forming apparatus. As a result, the bypass feeder 70 and the image forming apparatus 1 incorporating the bypass feeder 70 can reduce costs.

Further, in the bypass feeder 70 according to the present embodiment, when the opening/closing unit 71 is changed from the unit closed state to the unit open state while the bypass tray 72 is in the tray open state, the link unit 73 employs a leg open linkage that moves in a direction to stretch the linear member 81. With this configuration, the angle of inclination of the bypass tray 72 with respect to the opening/closing unit 71 in the unit open state is smaller than the angle of inclination of the bypass tray 72 with respect to the opening/closing unit 71 in the unit closed state. As a result, the angle of inclination of the bypass tray 72 to the horizontal line can be held at an angle of inclination of the bypass tray 72 at which the sheet S loaded on the sheet loading surface 72B of the bypass tray 72 does not slidably fall from the bypass tray 72.

In the bypass feeder 70 according to the present embodiment, the opening/closing unit 71 includes the through hole 71B through which the linear member 81 passes. Therefore, when the bypass tray 72 is in the upright attitude with respect to the opening/closing unit 71 in the tray closed state, the linear member 81 can be stored between the opening/closing unit 71 and the bypass tray 72. As a result, this configuration can reduce the size of the bypass feeder 70 and the image forming apparatus 1 including the bypass feeder 70.

In the bypass feeder 70 according to the present embodiment, the other end of the linear member 81 is connected to the spring 82 that pulls the linear member 81. With this configuration in which the linear member 81 is pulled by the spring 82, the amount of sagging of the linear member 81 can be reduced.

In the bypass feeder 70 according to the present embodiment, the position fixing member 83 is disposed at the other end of the linear member 81 and the stopper 84 is provided on the bypass tray 72. Further, the position fixing member 83 contacts the stopper 84, so that the angle of inclination of the bypass tray 72 is adjusted. Specifically, a contact of the position fixing member 83 to the stopper 84 can adjust the angle of inclination of the bypass tray 72. With this configuration, the angle of inclination of the bypass tray 72 with respect to the opening/closing unit 71 is controlled.

In the above-described embodiments, the other end of the linear member 81 is fixed to the bypass tray 72 via the spring 82. However, the configuration according to example embodiments is not limited thereto. For example, the other end of the linear member 81 can be connected to the bypass tray 72 directly. This configuration can achieve the same effect as the configuration of the above-described embodiment. However, when the opening/closing unit 71 is in the unit closed state and the bypass tray 72 is in the tray open state, the linear member 81 may be slackened.

In the above-described embodiments, the image forming apparatus 1 corresponds to a copier. However, as previously described, the image forming apparatus 1 is not limited to the copier. For example, a printer can be the image forming apparatus 1.

In the above-described embodiments, the sheet reversing path R3 and the re-entry path R4 are provided in the opening/closing unit 71. However, the configuration is not limited thereto. For example, the sheet reversing path R3 can be provided in the apparatus body 2.

The above-described simple configuration of the bypass feeder described in the present embodiment can provide the effect that a simple configuration prevents sheets from falling off the bypass tray, and therefore is useful to the bypass feeder and the image forming apparatus according to the example embodiment.

The above-described example embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A bypass feeder attached to an apparatus body of an image forming apparatus, the bypass feeder comprising:

an opening/closing unit having a first fulcrum;

the opening/closing unit configured to rotate about the first fulcrum and to open and close with respect to the apparatus body between a unit closed state in which the opening/closing unit is disposed at a position close to the apparatus body and a unit open state in which the opening/closing unit is disposed at a position separated from the apparatus body;

a bypass tray having a sheet loading surface on which a sheet is loaded and having a second fulcrum, the bypass tray configured to rotate about the second fulcrum and to open and close with respect to the opening/closing unit between a tray closed state in which the bypass tray is disposed at a position close to the opening/closing unit and a tray open state in which the bypass tray is disposed at a position separated from the opening/closing unit;

a linkage including two arms having a first arm and a second arm and a fixing member to openably connect the opening/closing unit to the apparatus body, the fixing member being provided at an intermediate part of one of the first arm or second arm;

a support having one end fixed to the fixing member of the linkage and other end attached to an elastic member in the bypass tray; and a first through-hole in the opening/closing unit and a second through-hole in the bypass tray, wherein the support passes through the first and second through-holes, and wherein the bypass tray covers the elastic member such that the support extends through the second-through hole from an inside of the bypass tray to an outside of the bypass tray.

2. The bypass feeder according to claim 1, wherein one end of the first arm is rotatably connected to one end of the second arm, wherein the other end of the first arm is rotatably connected with respect to the apparatus body, and wherein the other end of the second arm is rotatably connected with respect to the opening/closing unit.

3. The bypass feeder according to claim 1, wherein the elastic member is a spring.

4. The bypass feeder according to claim 1, further comprising a position fixing member disposed at one end of the support; and a stopper provided on the bypass tray, wherein the position fixing member contacts the stopper.

5. An image forming apparatus comprising:

an image forming unit to form an image on a recording medium; and the bypass feeder according to claim 1.

6. The bypass feeder according to claim 1, wherein the support is a flexible member.

7. The bypass feeder according to claim 1, wherein the support is a bendable member.

8. A bypass feeder attached to an apparatus body of an image forming apparatus, the bypass feeder comprising:

an opening/closing unit having a first fulcrum, the opening/closing unit configured to rotate about the first fulcrum and to open and close with respect to the apparatus body between a unit closed state in which the opening/closing unit is disposed at a position close to the apparatus body and a unit open state in which the opening/closing unit is disposed at a position separated from the apparatus body;

a bypass tray having a sheet loading surface on which a sheet is loaded and having a second fulcrum, the bypass tray configured to rotate about the second fulcrum and to open and close with respect to the opening/closing unit between a tray closed state in which the bypass tray is disposed at a position close to the opening/closing unit and a tray open state in which the bypass tray is disposed at a position separated from the opening/closing unit;

a linkage including two arms having a first arm and a second arm and a fixing member to openably connect the opening/closing unit to the apparatus body, the fixing member being provided at an intermediate part of one of the first arm or second arm;

a support having one end fixed to the fixing member of the linkage and other end attached to an elastic member in the bypass tray, the support contacts the opening/closing unit; and a first through-hole in the opening/closing unit and a second through-hole in the bypass tray, wherein the support passes through the first and second through-holes, and wherein the bypass tray covers the elastic member such that the support extends through the second-through hole from an inside of the bypass tray to an outside of the bypass tray.

9. The bypass feeder according to claim 8, wherein one end of the first arm is rotatably connected to one end of the second arm, wherein the other end of the first arm is rotatably connected with respect to the apparatus body, and wherein the other end of the second arm is rotatably connected with respect to the opening/closing unit.

10. The bypass feeder according to claim 8, wherein the elastic member is a spring.

11. The bypass feeder according to claim 8, further comprising a position fixing member disposed at one end of the support; and a stopper provided on the bypass tray, wherein the position fixing member contacts the stopper.

12. An image forming apparatus comprising:

an image forming unit to form an image on a recording medium; and the bypass feeder according to claim 8.

13. The bypass feeder according to claim 8, wherein the support is a flexible member.

14. The bypass feeder according to claim 8, wherein the support is a bendable member.

15. The bypass feeder according to claim 1, wherein the elastic member and the support are in the same plane.

16. The bypass feeder according to claim 8, wherein the elastic member and the support are in the same plane.

* * * * *